US007930790B2

(12) United States Patent
Sivik et al.

(10) Patent No.: US 7,930,790 B2
(45) Date of Patent: Apr. 26, 2011

(54) FABRIC EXFOLIATION METHOD AND ARTICLES

(75) Inventors: Mark Robert Sivik, Mason, OH (US); Jeffrey Lee Butterbaugh, Cincinnati, OH (US); Tulani Leola Soffin, Cincinnati, OH (US); Brian Wayne Everingham, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/080,864

(22) Filed: Apr. 7, 2008

(65) Prior Publication Data

US 2008/0263794 A1 Oct. 30, 2008

Related U.S. Application Data

(60) Provisional application No. 60/926,309, filed on Apr. 26, 2007.

(51) Int. Cl.
*A47L 25/00* (2006.01)

(52) U.S. Cl. ..... 15/104.002; 8/115.51; 442/327; 442/370; 428/304.4; 428/309.9; 428/316.6; 428/317.1; 428/317.9

(58) Field of Classification Search ..... 8/115.51; 428/316.6, 304.4, 317.1, 317.9, 309, 9, 309.9; 442/327, 370; 521/187; 15/104.002
See application file for complete search history.

(56) References Cited

U.S. PATENT DOCUMENTS

| | | | | |
|---|---|---|---|---|
| 4,769,913 | A | 9/1988 | Kuramochi | |
| 6,350,511 | B2 | 2/2002 | Thom | |
| 6,503,615 | B1 | 1/2003 | Horii et al. | |
| 6,608,118 | B2 * | 8/2003 | Kosaka et al. | 521/187 |
| 6,855,739 | B2 | 2/2005 | Becker et al. | |
| 7,033,965 | B2 | 4/2006 | Takabayashi et al. | |
| 7,309,182 | B2 * | 12/2007 | McKay | 401/138 |
| 7,341,635 | B2 | 3/2008 | Hayashi et al. | |
| 2002/0163105 | A1 | 11/2002 | Kosaka et al. | |
| 2003/0211959 | A1 | 11/2003 | Thomas et al. | |
| 2004/0005831 | A1 | 1/2004 | Gillette | |
| 2004/0033926 | A1 | 2/2004 | Szewczyk et al. | |
| 2004/0053807 | A1 | 3/2004 | Thomas et al. | |
| 2004/0086321 | A1 * | 5/2004 | Burkholz et al. | 401/190 |
| 2005/0136238 | A1 * | 6/2005 | Lindsay et al. | 428/304.4 |
| 2005/0155630 | A1 | 7/2005 | Kilkenny et al. | |
| 2005/0155631 | A1 | 7/2005 | Kilkenny et al. | |
| 2005/0175786 | A1 * | 8/2005 | Singh et al. | 427/407.1 |
| 2005/0202232 | A1 * | 9/2005 | Sauniere | 428/316.6 |
| 2005/0266229 | A1 | 12/2005 | Porticos et al. | |
| 2005/0266230 | A1 * | 12/2005 | Hill et al. | 428/317.9 |
| 2006/0000043 | A1 | 1/2006 | Jou-Chen et al. | |
| 2006/0003912 | A1 | 1/2006 | Lindsay et al. | |
| 2006/0005338 | A1 | 1/2006 | Ashe et al. | |
| 2006/0052269 | A1 | 3/2006 | Panandiker et al. | |
| 2006/0135026 | A1 | 6/2006 | Arendt et al. | |
| 2006/0194893 | A1 | 8/2006 | Prybutok | |
| 2006/0229229 | A1 | 10/2006 | Bednarz et al. | |
| 2006/0245816 | A1 | 11/2006 | Sharp et al. | |
| 2006/0252324 | A1 | 11/2006 | Julemont et al. | |
| 2006/0288600 | A1 * | 12/2006 | Taylor | 34/60 |
| 2007/0180637 | A1 * | 8/2007 | McKay | 15/22.1 |
| 2007/0251545 | A1 | 11/2007 | Dreja et al. | |
| 2008/0115803 | A1 * | 5/2008 | Tuman et al. | 134/6 |

FOREIGN PATENT DOCUMENTS

| | | | |
|---|---|---|---|
| JP | 2003064552 | A | 3/2003 |
| JP | 2003081842 | A | 3/2003 |
| JP | 2004041250 | A | 2/2004 |
| JP | 2004043982 | A | 2/2004 |
| JP | 2004051699 | A | 2/2004 |
| JP | 2005-143870 | * | 6/2005 |
| WO | WO0106906 | | 2/2001 |
| WO | WO 2005/026308 | A1 | 3/2005 |

* cited by examiner

*Primary Examiner* — Ling-Siu Choi
*Assistant Examiner* — Bijan Ahvazi
(74) *Attorney, Agent, or Firm* — Stephen T. Murphy; Kim W. Zerby; Leonard W. Lewis

(57) ABSTRACT

The present invention is directed to methods for removing unwanted materials from the surface of fabrics—such as lint, pills, fuzz, and hair—by contacting the fabric with an open-cell foam or an article of manufacturer comprising an open cell foam and a non-soiling and non-staining benefit agents and/or an auxiliary means for trapping material removed by the fabric exfoliation method.

4 Claims, No Drawings

FABRIC EXFOLIATION METHOD AND ARTICLES

CROSS-REFERENCE

This application claims benefit of Application Ser. No. 60/926,309 filed Apr. 26, 2007.

TECHNICAL FIELD

The present invention relates to a method for removing lint, pills, fuzz, hair and other foreign artifacts from the surface of fabrics, especially consumer garments, and articles of manufacture useful for practicing the present invention method.

BACKGROUND OF THE INVENTION

Everyone knows how difficult it can be to remove unwanted particulate materials (especially fibrous particulate matter such as lint, pills, fuzz, hair and other foreign artifacts) from the surface of fabrics, especially knit fabrics such as sweaters. Use of a lint roller made with an adhesive tape can be effective for loosely bound hair and lint, but the adhesive tends to have limited effectiveness at removing foreign artifacts from the surface depending on the type of garment, size of artifact and degree of entanglement of the artifact in the surface of the fabric. Adhesives are generally ineffective at removing pills from knit fabrics. Lint shavers also have proven to be effective at removing foreign artifacts from the surface of fabrics, but they have the significant drawback of risking damage to the garment from excessive cutting of the garment's fibers, yarns and textile surface.

It has been discovered by the present invention that certain open-cell foams, such as polyurethane and melamine foams, can be used to remove lint, pills, fuzz, hair and other foreign artifacts from the surface of fabrics, such as consumer garments. Such foams have the advantage of being effective at removing a broad range of unwanted materials from the surface of garments while having a low risk of damaging the garment in the process. For example, the use of open-cell foam minimizes the risk of cutting or snagging of certain textiles, such as knits, that would damage the garment being treated. Open-cell foams include melamine foams that can be used to safely and effectively to remove pills, lint, fuzz and hair from garments. An added benefit of using the present method of removing pills, lint, fuzz and hair from garments with an open-cell foam is that it restores the appearance of the garment to a newer looking or rejuvenated state, and can provide allergen reduction by removal of allergens (such as pet hairs) from the fabric.

SUMMARY OF THE INVENTION

The present invention is directed to a method for fabric exfoliation, said method comprising contacting with agitation the surface of a fabric in need of exfoliation with the functional surface of a fabric exfoliation article, said functional surface comprising an open-cell foam.

The present invention is also directed to articles of manufacture (such as implements) containing open-cell foams, which articles are useful for practicing the fabric exfoliation method of the present invention.

The present invention is also directed to articles which comprise, in addition to the open cell foam, auxiliary means for trapping the unwanted material removed by the fabric exfoliation method. This means may be an adherent material and/or physical structure designed to trap or collect the unwanted materials removed by the open-cell foams in order to avoid transfer of these unwanted materials back to the fabric. This can be accomplished, for example, by designing the article to collect the removed materials in crevices, grooves, holes, and slots, and/or including an adhesive material portion with the article such that the unwanted materials are effectively adhered to the article once removed from the fabric being treated. Inclusion of a secondary surface as part of the article, such as porous mesh, may also be used to collect the removed materials.

The present invention is also directed to open-cell foam-containing articles releasably comprising (with or without auxiliary means for trapping the removed materials) one or more non-soiling and non-staining benefit agents. These benefit agents may impart a benefit to the fabric being treated or to the process of treating the fabric to remove unwanted materials. Such agents include, for example, perfume ingredients (the article may be designed such that the perfume is transferred to the fabric or simply to the surrounding atmosphere in order to improve the aesthetics of the process), static control agents (to impart a benefit to the fabric or to minimize static build-up during use of the article, thereby helping to prevent redeposition of the removed lint, etc.), and/or lubricants (to impart a benefit to the fabric and/or assist in allowing the open-cell foam to more freely contact the textile without risk of damage).

The present invention is also directed to articles which comprise multiple surfaces having different open-cell foams (e.g., one side has one type of foam and the other side has another) which are effective on different types of textiles to allow for a wider range of usage of the same article on a wider variety of fabrics or garments.

DETAILED DESCRIPTION OF THE INVENTION

As used herein, the following terms have the indicated meaning.

"Fabric exfoliation", as used herein, means the act of removing all or part of unwanted materials, such as fiber-based particulate matter, including by way of example lint, pills, fuzz, and hair, as well as other foreign artifacts, from the surface of fabrics.

"Fabric in need of exfoliation", as used herein, means the surface portion of a fabric having unwanted materials, such as lint, pills, fuzz, hair and other foreign artifacts on it; this surface portion may be all of the fabric surface or only a part thereof. Fabrics in need of exfoliation include, but are not limited to, consumer clothing, fine fabrics, linens, draperies, around the house textiles, window treatments, etc., and especially delicate knit consumer clothing such as a fine knit acrylic or cashmere sweater.

"Auxiliary means for trapping the unwanted material removed by fabric exfoliation", as used herein, means any adherent material and/or physical structure designed to trap or collect the unwanted materials removed from a fabric in need of exfoliation by an open-cell foam in order to avoid transfer of these unwanted materials back to the fabric being treated.

"Benefit agents", as used herein, means any ingredient or combination of ingredients incorporated into and/or onto a fabric exfoliation article of manufacture useful for the present invention fabric exfoliation method whereby this ingredient or combination of ingredients impart: 1) a benefit to the fabric in need of exfoliation as a result of using the article for the fabric exfoliation method, and/or 2) a benefit to the process of fabric exfoliation as a result of using the article for the fabric exfoliation method.

"Functional surface of a fabric exfoliation article", as used herein, means the one or more surfaces of a fabric exfoliation article comprising an open-cell foam exposed such that it can be contacted with the surface of a fabric in need of exfoliation.

Method for Fabric Exfoliation:

The present invention is directed to a method for fabric exfoliation, said method comprising contacting a fabric in need of exfoliation with an open-cell foam as described herein below. Preferred methods for fabric exfoliation use a fabric exfoliation article of manufacture as described herein below.

The method of contacting the open-cell foam with the fabric in need of exfoliation can be any process which provides sufficient interaction between the foam and the fabric surface to effect removal of at least some of the unwanted materials. Contact effected by a consumer's use of a fabric exfoliation article can be by any typical means, such as rubbing, wiping, brushing, combing, teasing-out, and the like, or any other means of mechanical agitation that provides frictional contact between the functional surface of the fabric exfoliation article and the surface of the fabric in need of exfoliation, and depends in part on the shape and design of the article being used.

Open-Cell Foam:

Open-cell foams are well known. "Open-cell" and "open celled", as used herein, is defined in the article "Cellular Materials", by Imeokparia et al, published in *Encyclopedia of Polymers Science and Technology*, Vol. 5, (Copyright 1999-2007 by John Wiley & Sons, Inc.; article published online 15 Oct. 2003) as follows: "The gas phase in a cellular polymer is distributed in voids, pores, or pockets called cells. If these cells are interconnected in such a manner that gas can pass from one to another, the material is termed open-celled. If the cells are discrete and the gas phase of each is independent of that of the other cells, the material is termed closed-celled." (At page 419; emphasis in original.) "The fraction of open cells expresses the extent to which the gas phase of one cell is in communication with other cells. When a large portion of cells are interconnected by gas phase, the foam has a large fraction of open cells, or is an open-celled foam. Conversely, a large proportion of noninterconnecting cells results in a large fraction of closed cells, or a closed-celled foam." (At page 437; emphasis in original.)

Open-cell foams useful herein are foams in which at least 50% of all of the lamellae on the functional foam surface being used to practice the present invention fabric exfoliation method are open, preferably from 60 to 100%, and particularly preferably from 65 to 99.9%, determined to DIN ISO 4590 [Rigid Cellular Plastics Standard—Determination of the volume percentage of open and closed cells]. It is to be noted that a functional surface comprising open-cell foams may therefore be obtained from closed-cell foams which have been cut or otherwise treated (in order to create open cells from closed cells on at least one surface by opening up at least some of the closed cells) to result in at least 50% of all of the lamellae for the cells on the foam surface being used to practice the present invention fabric exfoliation method being open (the rest of the cells below that surface may be closed or, preferably, open). Preferred foams are those wherein the entire foam structure has at least 50% of all of the lamellae being open-cell, preferably from 60 to 100%, and particularly preferably from 65 to 99.9%.

The fabric exfoliation method of the present invention uses the open-cell foam surface to remove the unwanted materials from the surface of fabrics. Open-cell foams useful herein have an average pore diameter (number-average) in the range from 1 μm to 5 mm, preferably from 1 μm to 3 mm, and preferably from 50 μm to 2 mm, determined via evaluation of micrographs of sections. A variety of foams are useful herein, non-limiting examples include foams which comprise at least one water-insoluble polymer selected from the group consisting of polyurethane, melamine-formaldehyde and its derivatives, polyester, nylon, polystyrene, styrene copolymers, polybutadiene, butadiene copolymers, polyvinylesters, polyvinylethers, copolymers from (meth)acrylic acid with at least one (meth)acrylate, polyethylene and wax derivatives thereof, polypropylene and wax derivatives thereof, polyethylene-copolymers, polypropylene-copolymers, and ethylene-propylene-diene-copolymers and combinations thereof. Preferred open-cell foams are selected from polyurethane, melamine-formaldehyde and its derivatives, polyester, and combinations thereof.

Preferred open-cell foam has a density in the range from 2 to 2,000 kg/m$^3$, preferably from 4 to 1000 kg/m$^3$, and preferably in the range from 5 to 600 kg/m$^3$. Further, the open cell foams are preferably rigid open-cell foams. For the purposes of the present invention, rigid open-cell foams are those foams whose compressive strength, determined to DIN 53577 Standard (Determination of compression stress value and compression stress-strain characteristic for flexible materials characteristics), is 1 kPa or above at 40% compression.

The preferred open-cell foams have a rigidity and/or density sufficient to minimize breakage of the foam during ordinary use to accomplish the fabric exfoliation method of the present invention. Excessive breakage is undesirable due to the production of a residue of foam that remains on the fabric being treated. Depending on the color of the fabric being treated and the foam used, the residue will be more or less apparent to the consumer. Therefore preferred open-cell foams do not leave a consumer noticeable residue (i.e., the majority of consumers using the open-cell foam to practice the present invention fabric exfoliation method do not view the amount of residue, if present, as a significant negative) under ordinary usage conditions.

Foams useful for the present invention can be compressed to add strength to the fabric exfoliation article. For example, melamine-formaldehyde foams can be compressed for added strength, such as is taught in U.S. Pat. No. 6,608,118 B2, issued Aug. 19, 2003 to Kosaka et al. Melamine-formaldehyde foam for use herein includes melamine-formaldehyde resin foam produced and commercially marketed by BASF under the trade name Basotect®. Non-compressed foams have an average tensile strength using an Instron Strength Instrument for a 3.18 mm×19.05 mm×120.65 mm strip until the foam breaks of 0.75 kilogramsforce. Melamine-formaldehyde foams useful herein can be compressed to produce stronger foams. These foams have an average tensile strength using the same method of 1.25 kilogramsforce. In one embodiment, foams are used which have been compressed to from 1.2 to 20 times their original state. Compression of cell size can be measured using microscopy tools as well as standard methods described in DIN 53577.

Polyurethanes are well-known polymers connected by carbamate or urethane groups. The class of polyurethanes useful herein may be supplemented by ureas, isocyanurates, esters, biurets, allophanates, amides, carbonates and mixtures thereof. The polyurethane foam can be made by reacting polols, isocyanates, water, catalysts and additives to produce foams of various characteristics including but not limited to antioxidants to maintain the foams' integrity from being brittle and/or discolored.

In one embodiment, commercial polyurethane foams are used in the present invention methods and articles, for example those obtained from Crest Foam Industries, Inc.

(Moonachie, N.J.) or Foamex (Eddystone, Pa.) that have pore content 10 ppi, 15 ppi, 20 ppi, 30 ppi, 40 ppi and 500 ppi (where "ppi" means "pores per inch"). Pore size can be determined by visual measurement and pressure drop. Pore size is used to describe one side or face of a cell. The pressure drop method is described in the glossary of terms provided by Foamex Technical Products Division at "foamex.com" and is a measure of the height of a certain amount of water that is needed for a given area to push air through a filter or porous material. The pressure relates to the pore size. Fine pores cause more restriction versus coarse pores. Non-limiting examples of polyurethane foams from Foamex that are commercially available are SIF Felt® foams made by the Z process.

Fabric Exfoliation Article of Manufacture:

The fabric exfoliation article of manufacture useful for the present invention fabric exfoliation method comprises an open-cell foam as described herein before, either as the sole component of the article or preferably with a second component. The second component is preferably selected from the group consisting of benefit agents, auxiliary means for trapping the unwanted material removed by fabric exfoliation, additional materials, and combinations thereof. Any second component(s) optionally present in the fabric exfoliation article may be any suitable material other than the open-cell foam. A second component which is an additional material may be suitable to provide beneficial features to the fabric exfoliation article other than those benefits provided by benefit agents, such as increased rigidity or increased grip provided by a second foam material (especially a rigid foam material) or a handle made of a foam material, thermoplastic material, wood, and/or metal.

The fabric exfoliation article of manufacture may be of any shape and/or size and/or volume suitable for use for the present invention fabric exfoliation method. In a highly preferred embodiment, the fabric exfoliation article is in a shape and/or size and/or volume suitable for a consumer to use by hand to perform the present invention fabric exfoliation method. Examples of various forms for the fabric exfoliation articles are sheets, wipers (e.g., shaped and/or textured bars or pads), brushes, and cloths.

The shape of the fabric exfoliation article, such as a wiper, may be chosen for reasons of aesthetics and/or manufacturing convenience and/or ease of consumer handling and ergonomics, but the chosen shape must have sufficient surface area exposed for the open-cell foam surface of the article to allow for its contact with the fabric in need of exfoliation. Typical shapes therefore include: sheets, cubes, rectangles, parallelepipeds, pyramids, cylinders, cones, pencil erasers, cuboids, tetrahedrons, hexagons, trapezoids, octahedrons, tubular, spheres, globular shape, and ellipsoid shape. Preferably, the article has a shape selected from the group consisting of: sheets, cube shape, rectangular shape, pencil eraser shape, and cuboid shape.

Suitable volumes of the fabric exfoliation articles herein may be from 1 $cm^3$ to 10,000 $cm^3$, preferably from 10 $cm^3$ to 1,000 $cm^3$, more preferably from 50 $cm^3$ to 250 $cm^3$. Again, preferred volumes are selected such that a typical consumer can handle the article during use.

In a preferred embodiment the fabric exfoliation article has a parallelepipedic shape defined by three groups of parallel and equal length sides, referred to as a, b and c, wherein a ranges from 2 cm to 20 cm, preferably 4 cm to 8 cm, b ranges from 2 cm to 20 cm preferably 8 cm to 15 cm, and c ranges from 1.5 cm to 5 cm, preferably 2 cm to 4 cm. The open-cell foam may make up some or all of this article.

In a preferred embodiment, the thickness of the open-cell foam layer of the article is from 5 mm to 200 mm, preferably from 7 mm to 100 mm, more preferably 10 mm to 60 mm, even more preferably from 15 mm to 60 mm, still more preferably from 20 mm to 60 mm.

In another preferred embodiment the fabric exfoliation article comprises more than one material. In this embodiment at least one layer comprises the open-cell foam, and the additional layer(s) comprises a second layer of material which may be, for example, a non-foam backing material to serve as a grip for the consumer to better hold the article or a different open-cell foam. Preferably the second layer is an additional material made of a second foam material (as discussed herein below under the section "Additional Materials"); such a fabric exfoliation article has the open-cell foam layer bonded directly to the second foam material layer. Such additional materials may also serve to preserve the integrity of the foam during use.

For articles comprising layers of both open-cell foam and second foam, these layers of materials may be arranged in any way suitable. In a preferred embodiment the layers of open-cell foam and second foam are arranged parallel to at least one side, preferably two opposite sides, of the fabric exfoliation article. However, such articles may have an irregular shape. Indeed, the thickness of the various layers may be constant or vary throughout the article. The interface line between the two layers may be a straight line, or may also be constructed such that the interface of the layers is not a straight line, such as a bend or is completely irregular. In addition, the separation plane of the layers may be in the center of fabric exfoliation article, dividing the article in two equal layers, or may be in the upper or lower part of the article. In addition, the fabric exfoliation article may be in the shape of a sphere or a globule or an ellipsoid with the separation plane of the layers forming a spherical segment or one of the layers, preferably the layer of a second foam here, forming a nested structure, sphere in a sphere (similar to the nested layers of an onion).

In the preferred embodiment wherein the fabric exfoliation article herein has a cuboid shape, the line indicating the interface of the two layers positioned in a facial relationship (or the surface areas where the two layers are joined together) of the article is preferably substantially parallel (preferably parallel) to the side of the cuboid shaped article having the largest surface area.

In another preferred embodiment herein the fabric exfoliation article is in the shape of a pencil eraser. By "shape of a pencil eraser" it is meant herein a voluminous body having six walls, wherein three pairs of parallel and equally shaped and sized walls exist and wherein one pair of walls are in the shape of a parallelogram and the remaining two pairs of walls are of rectangular shape. In this preferred embodiment, the line indicating the interface of the two layers (or the surface areas where the two layers are joined together) of the article is preferably substantially parallel (preferably parallel) to the side of article in the shape of a pencil eraser having the largest surface area.

The preferred fabric exfoliation articles comprising an open-cell foam layer and second foam layer have these layers attached to each other. This attachment can be achieved by any attachment means suitable for joining the materials present in the two layers. The attachment may be either a permanent attachment or a temporary attachment. Suitable attachment means providing a permanent attachment are selected from the group consisting of: foam flame laminating the two layers together; use of a permanent adhesive; sewing the two layers together; and needle-punching the two layers together; and combinations thereof. Suitable attachment means providing a temporary attachment are selected from the group consisting of: a weak adhesive; Velcro®; and a water-based, water-soluble coating or adhesive; and combinations thereof. In a preferred embodiment the layers are permanently attached.

The fabric exfoliation article may contain more than two layers, wherein said additional layers may be the same or similar materials as the open-cell foam or said second foam, or may be made of additional materials having different properties therefrom. The fabric exfoliation article may be in a so-called laminar configuration when three layers are present. In a preferred embodiment the fabric exfoliation article is in a laminar configuration wherein the middle layer is a second foam, at least one of the two outer layers is an open-cell foam, and the other outer layer is either an open-cell foam or another material providing another feature, such as abrasiveness, increased rigidity, or porous-ness such as a mesh, or is coated with an adhesive to collect exfoliated lint, pills, fuzz or hair. In a preferred embodiment the fabric exfoliation article comprises a laminar configuration having two outer layers of open-cell foam and an inner layer of a second foam material.

The layers of the fabric exfoliation article may cover each other either partially or fully. By a "partial coverage" is meant that at least one of the layers overlaps the other layer (or other layers, if any) and is not fully covered by said other layer (or other layers, if any). By a "full coverage" is meant that the layers of the fabric article do fully cover each other and that none of the layers substantially overlap the other layer (or other layers, if any).

The ratio of open cell foam to a second foam in the fabric exfoliation article according to the present invention is preferably from 20:1 to 1:20 by volume, more preferably from 10:1 to 1:10 by volume, even more preferably 5:1 to 1:1, still more preferably 5:1 to 2:1, and most preferably from 4:1 to 3:1 by volume.

In order to obtain suitable fabric exfoliation articles, the open-cell foam and any second foam-raw materials may have to be modified in shape and/or size. This modification can be done by any means known to those skilled in the art. Suitable means of modifying the shape and/or size of the open cell foam (e.g., melamine foam) and second foam raw materials may be selected from the group consisting of: cutting, breaking, tearing, compressing, and combinations thereof.

(a) Benefit Agents:

The fabric exfoliation articles herein optionally, but preferably, comprise at least one non-soiling and non-staining benefit agent as a second component. Non-soiling and non-staining is defined as a benefit agent that does not leave a visible residue (e.g., spots, oil rings, article fragments, etc.) when the benefit agent is applied to or comes into contact with the fabric being exfoliated. The appearance of the fabric surface may change color or appearance due to removal of pills and fuzz from the fabric surface but is not altered by the benefit agent. Staining/soiling can be measured using the reflectance spectra of the fabric surface. The specta of an untreated surface can be determined by the Hunter color scale in coordinate space, defined as L*,a*,b* or L*,C*,h* of the fabric. As used herein, the "L*C*h color space" and "L*a*b* color space" are three dimensional calorimetric models developed by Hunter Associates Laboratory and recommended by the Commission Internationale d'Eclairage ("CIE") to measure the color or change in color of a dyed article. The CIE L*a*b* color space ("CIELAB") has a scale with three-fold axes with the L axis representing the lightness of the color space (L*=0 for black, L*=100 for white), the a* axis representing color space from red to green (a*>0 for red, a*<0 for green) and the b* axis representing color space from yellow to blue (b*>0 for yellow, b*<0 for blue). The L*C*h color space is an approximately uniform scale with a polar color space. The CIE L*C*h color space ("CIELCh") scale values are determined instrumentally and may also be calculated from the CIELAB scale values. The L* lightness value is the same for both the CIELCh and CIELAB color scales. The C* value (chroma value) and the h value (hue angle) may be calculated from the a* and b* values of the CIELAB scale. All colors may be represented by a coordinate in the L*a*b* color space and changes in colors may be represented by the vector corresponding to the coordinate difference between an initial color and a final color. Term definitions and equation derivations are available from Hunter Associates Laboratory, Inc. and from www.hunterlab.com, and are incorporated in their entirety by reference herein. The change in appearance of the treated area is measured as $\Delta E$. $\Delta E$ is equal to the sum of the difference squared in L*,a*, and b*. A $\Delta E<1.0$ units is deemed to be non-staining and non-soiling.

Benefit agents may be added into any part of the fabric exfoliation article, such as the open-cell foam, or may be coated or layered onto part or all of the surface of the article. The coating level may range from have zero coating to 5 $g/m^2$, preferably 3 $g/m^2$, and more preferably 1 $g/m^2$. Each benefit agent may individually comprise in total from 0.0001% to 10% by weight of the fabric exfoliation articles on a weight basis, regardless of whether included onto and/or into the article. Benefit agents include, but are not limited to, materials selected from the following.

(i) Biocides: Biocides include materials such as silver particles or monomeric or polymeric organic biocides, such as phenoxyethanol, phenoxypropanol, glyoxal, thiadiazines, 2,4-dichlorobenzyl alcohols, and preferably isothiazolone derivatives, such as MIT (2-methyl-3(2H)-isothiazolone), CMIT (5-chloro-2-methyl-3(2H)-isothiazolone), CIT (5-chloro-3(2H)-isothiazolone), BIT (1,2-benzoisothiazol-3(2H)-one), and also copolymers of N,N-di-$C_1$-$C_{10}$-alkyl-□-amino-$C_2$-$C_4$-alkyl(meth)acrylate, in particular copolymers of ethylene with N,N-dimethyl-2-aminoethyl(meth)acrylate.

(ii) Abrasive Materials: Abrasive materials may be inorganic or organic materials, e.g. sand, lime ($CaCO_3$), silicates with an average particle diameter (number-average) in the range from 1 μm to 1 mm, or colloidal silica, preferably inorganic material are selected from oxides, chlorides, sulfates, phosphates, carbonates of Mg, Mn, Ba, Ca, Al, W, Zr, Ti, Si, Mo, in particular $TiO_2$, $SiO_2$, sand and $Al_2O_3$. Other suitable materials are insoluble sodium polymetaphosphate, hydrated alumina, dicalcium orthophosphate dihydrate, calcium pyrophosphate, tricalcium phosphate, calcium polymetaphosphate. Water insoluble particles having a Mohs hardness in the range of 0.005 to 5.5 are preferred.

(iii) Surfactants: One or more surfactants, which may be anionic, cationic, zwitterionic, or non-ionic.

(iv) Deodorizers: Deodorizers include carbon based materials such as carbon black, activated carbon, charcoal, activated or non-activated, and may be porous or not, as well as cyclodextrins.

(v) Anti-static Agents: Typical anti-static agents are cationically charged materials such as non-volatile amines, oligoamines, polymeric amines, quaternary amines and quaternary polymeric amines, some of which are commonly used in liquid fabric softener compositions and in dryer-added laundry sheets. In addition, water and hygroscopic materials can provide anti-static benefits.

(vi) Lubricants: Lubricants include materials such as silicone oils and siloxane, mineral and plant or animal oils and low friction polymer such as fluorinated polymers.

(vii) Anti-allergens: Anti-allergens include materials such as eucalyptus, ylangylang, wintergreen, silica nanoparticles and benzyl benzoate.

(viii) Insect Repellents: Typical insect repellents include but not limited to citronella, DEET (N,N-diethyl-m-toluamide), butopyronxyl, carboxide, dibutyl phthalate, dimethylcarbate, dimethyl phthalate, ethylhexanediol, hexamide, icaridin, butyl methylcinchoninate, methylneodecanamide oxamate, Akrep®, Picaridin®, and rebemide.

(ix) Fabric Substantive Perfume Ingredients: These materials include perfume raw materials as well as perfume delivery systems such as capsules and microcapsules of the type and/or used at the level sufficient to impart a perfume benefit to the fabric being treated by the fabric exfoliation method of the present invention. A perfume or perfume delivery system is considered fabric substantive if following normal use of the article containing the perfume or perfume delivery system the fabric retains a consumer noticeable level of perfume. A perfume is considered consumer noticeable if the perfume raw materials are above their odor detection threshold (ODT). ODTs of perfume raw materials are determined by panelists at levels whereby the odor of a perfume raw material can be detected to give a response. Perfume released from the exfoliated fabric treated with a fabric exfoliation article containing a fabric substantive perfume ingredient can also be detected and measured using Headspace Gas Chromatography using the following method.

Headspace Gas Chromatography:

Equipment required consists of:

1.) a trap containing a porous polymer having the ability to retain aroma materials, preferably Tenax TA 35/60 mesh.

2.) a source of pure helium.

3.) a headspace collector to contain a 4 cm diameter circle of the fabric being analyzed and allow any perfume raw materials to partition into the vapor headspace and reach equilibrium.

4.) GC-MS with headspace capabilities.

Examples of suitable equipment is referenced in S. Maeno, P. A. Rodriguez. J. Chromatography, A731 (1996) 201-215. It consists of equipment to transfer the equilibrated headspace vapors containing perfume raw materials ingredients, which have been captured on a porous polymer, onto a GC for quantitative analysis. This equipment is able to heat the porous polymer trap containing the collected headspace, transferring the vapors to a cold trap cooled to <−100° C. (generally by liquid nitrogen). Following complete transfer to the cold trap, the cold trap is flash heated in a short period of time—typically about 1 minute—to a temperature of approximately 280° C., resulting in the transfer of the headspace vapors directly onto a capillary GC column. A typical column is a 30-60 meter long with an i.d. of 0.18-0.32 mm, with a stationary phase composed of 100% dimethylpolysiloxane or (5%-phenyl)-methylpolysiloxane. The GC has the capability of quantitating and identifying said perfume raw materials. Identification is accomplished via Mass Spectrometry and quantification is performed using a separate detector, such as an FID (flame ionization) or PID (photo ionization) detector.

Some of the benefit agents may be delivered as microcapsules incorporated into the fabric exfoliation articles. Microcapsules may be charged with at least one benefit active ingredient, such as one or more biocides, one or more perfume ingredients, anti-allergens, insect repellents, and deodorizers. The microcapsules may be, by way of example, friable, spherical hollow particles with an average external diameter in the range from 1 to 100 μm, which may be composed, by way of example, of melamine-formaldehyde resin, urea-formaldehyde resin, or of polymethyl methacrylate.

In one alternative of the fabric exfoliation articles, the open-cell foam incorporates one or more benefit agents, for example in proportions of from 0.001% to a total of 50% by weight, preferably from 0.001 to 30% by weight, preferably from 0.01 to 25% by weight, and further preferably from 0.1 to 20% by weight. In another embodiment, the surface of the open-cell foam of the article is coated (for example by spraying) with a fabric substantive perfume ingredient, lubricant, or combination thereof.

(b) Auxiliary Means for Trapping the Unwanted Material Removed by Fabric Exfoliation:

The fabric exfoliation articles herein preferably comprise at least one auxiliary means for trapping the unwanted material removed by the fabric exfoliation method. Such auxiliary means for trapping the unwanted material removed by the fabric exfoliation method may be incorporated into any part of the fabric exfoliation article, including the open-cell foam. Means for trapping the unwanted material removed by the fabric exfoliation method include, but are not limited to, the following adherent materials, structural components and physical features.

(i) Adherent Materials: Adherent materials are any materials that are capable of adhering the unwanted material to the fabric exfoliation article to help remove and/or to reduce the redeposition of this unwanted material onto the fabric surface. Such materials include materials and formulations identified for their tackiness, including but is not limited to common adhesive materials. Depending on the adherent material used, the article may be designed such that the adherent material directly contacts the fabric surface during and/or after the fabric exfoliation method (similar to the use of a lint roller) to collect the unwanted materials removed by the open-cell foam. In other designs the adherent material may be isolated from the fabric surface to avoid direct contact, for example by placing the adherent material in recesses in the fabric exfoliation article such as grooves or slits in the open-cell foam.

(ii) Anti-redeposition Structures: The fabric exfoliation articles may include as the means for trapping the unwanted material removed by the fabric exfoliation method structures which are capable of isolating, confining, and/or binding the unwanted materials. Such structures include porous mesh which allows the unwanted material to pass through and become isolated into a collection chamber (which chamber may be emptied after use of the article), or porous mesh that is capable of entangling the unwanted materials such that the material is bound to the article rather than being redeposited. Other anti-redeposition structures include Velcro™-like hooks that entangle and bind the unwanted materials, but care must be taken that such hooks are positioned so that damage to the fabric surface does not occur, for example by positioning the hooks in recesses in the fabric exfoliation article.

(iii) Physical Features: Physical features which can act as means for trapping the unwanted material removed by the fabric exfoliation method are surface variations of the fabric exfoliation article that are recesses from the surface of the article where the unwanted materials can collect. This can be accomplished, for example, by designing the article to collect the removed materials in macroscopic recesses, crevices, grooves, holes, ripples, waves, channels, slits and/or slots and similar recesses. These physical features may be as simple as recesses designed into the surface of the open-cell foam portion of the article, or may be made part of the article separate from the open-cell foam. The recess depth may range from 0.5% to 50% of the fabric exfoliation article total thickness in the direction of the recess, and more preferably 1% to 30% of the article thickness.

As noted above, these means can be combined. For example, physical features (e.g., channels in the surface of the open-cell foam) can be combined with adherent materials (e.g., adhesives) and/or anti-redeposition structures (e.g., Velco®-like hooks) to further enhance the removal of the unwanted materials.

(c) Additional Materials:

The fabric exfoliation articles herein preferably comprise at least one additional material. Additional materials may be added to any part of the fabric exfoliation article, such as the open-cell foam, or may be coated or layered onto or into part or all of the article. They include materials used to create handles or support structures for the open-cell foam, as well as ingredients which do not provide the benefits associated with benefit agents. Additional materials include, but are not limited to, materials selected from the following.

(i) Second Foam Material:

As noted herein before, preferred fabric exfoliation articles comprise (at least) one layer of a second foam (i.e., a foam which is not an open-cell foam). Suitable second foams for use herein are selected from the group of closed-cell foams consisting of: polyurethane foams; polypropylene foams; polyethylene foams; cellulose foam sponges; naturally occurring sponges; polyester foams; cross-linked polyethylene foams; and combinations thereof.

The thickness of a layer of a second foam, if present, is preferably up to 30 mm, preferably from 0.5 mm to 20 mm, preferably from 1 mm to 15 mm, preferably from 2 mm to 10 mm, and preferably from 4 mm to 8 mm. Furthermore, wherein the fabric exfoliation article comprises a layer of a second foam, the thickness of the open-cell foam layer is preferably from 7 mm to 100 mm, and preferably from 15 mm to 25 mm. In a preferred embodiment the total volume of a second foam layer is from 10 $cm^3$ to 100 $cm^3$, preferably from 20 $cm^3$ to 70 $cm^3$, preferably from 30 $cm^3$ to 60 $cm^3$, and preferably from 40 $cm^3$ to 50 $cm^3$.

(ii) Colorants: These include materials such as dyes and pigments used to color some or all of the fabric exfoliation article. Different colors may be used for different parts of the article, or designs and/or graphics can be colored into or on the article.

(iii) Non-Fabric Substantive Perfume Ingredients: Perfume ingredients may be added to the article which are not substantive to the fabric being treated, such as to simply improve the aesthetics of the article when removed from the packaging and/or during use.

Exfoliation Force

Artifacts that need to be removed from fabrics and textile surface range in the force required for those artifacts to be removed. Hair, transferred lint and other topical artifacts can be removed by dragging the open-celled foam across the fabric surface with an applied force. As pills, lint and other artifacts are more entangled into the fabric surface, an increased level of force is required to exfoliate the surface. The force required to achieve and exfoliated fabric surface can be measured by using a loadcell with the open-celled foam attached. This force can range from 4.4 N (Newton) to as much as 26.7 N. Too high of applied force can cause damage to a fabric surface during fabric exfoliation. For typical pills and fuzz, a preferred force to exfoliate the fabric surface is 4.4-22.5 N, preferably 8.9-17.8 N.

Packaging Means

The fabric exfoliation articles herein may be combined with a packaging means.

The packaging means herein may be any suitable means known to package articles, for example for purposes of shipping, distribution, and/or sale. Particularly suitable packaging means are selected from the group consisting of: paper bags, plastic bags, cartons, carton boxes, flow wraps, plastic wraps, paper wraps, and combinations thereof.

The packaging means herein may be printed and/or modified. In particular, such printing and/or other modification may be used to associate a brand-name and/or logo of the manufacturer of the fabric exfoliation article. Preferred packaging also contains written and/or graphic and/or electronic (e.g., a CD or DVD video) instructions directing the consumer in the proper use of the fabric exfoliation article to practice the fabric exfoliation method of the present invention. Such instructions may be on the outside surface of the package and/or presented as a separate insert in the package with the article.

Examples

The following examples will further illustrate the present invention. The following Examples are meant to exemplify articles and methods according to the present invention but are not necessarily used to limit or otherwise define the scope of the present invention.

I. Open-Cell Foams:

Abbreviations: DBTL: Dibutyl tin dilaurate, HMDI: 4,4'-diisocyanatocyclohexyl methane, IPDI: isophorone diisocyanate, DETA: diethylentriamine, IPDA: isophoron diamine.

I.1 Synthesis of Polyurethane Foam A:

A flask with stirrer is charged with 400 g (0.2 mol) of a polyesterdiol (hydroxyl number 56 mg KOH/g) to be made by condensation from adipic acid, neopentyl glycol and 1,6-hexandiol, 30 g (0.0084 mol) mono n-$C_4H_9$-capped polyethylenglycol (hydroxyl number 15 mg KOH/g), 0.15 g DBTL, and 30 g acetone. The resultant mixture is heated to 70° C. (reflux) under continuous stirring. Then, 129 g (0.49 mole) HMDI and 110 g (0.495 mol) IPDI are added, and stirring is continued at 70° C. for one hour. After that, 54 g (0.6 mol) 1,4-butanediol is added and stirring at 70° C. is continued for 2 hours. Then, the mixture is diluted with 710 ml of acetone, the mixture is cooled down to 50° C., and the isocyanate contents are determined: 1.02% by weight (calc.: 1.02% by weight). An amount of 25.3 g of a 50% by weight aqueous solution of 2-aminoethyl 2-aminoethanesulfonic acid is added. Ten minutes later, an amount of 870 g of water is added to disperse the polyurethane formed so far, and 6.5 g DETA and 2.4 g IPDA, dissolved in 100 ml water are added as crosslinkers and chain extenders. The acetone is removed by distillation under reduced pressure, and a 40% by weight solids content aqueous dispersion of polyurethane foam A having an average pore diameter of 2.0 mm is obtained.

I.2 Synthesis of Polyurethane Foam B:

A flask with stirrer is charged with 800 g (0.4 mol) of a polyesterdiol (hydroxyl number 56 mg KOH/g) made by condensation of isophthalic acid, adipic acid and 1,6-hexanediol, 80.4 g (0.6 mol) 1,1-dihydroxymethyl propionic acid, and 36 g 1,4-butandiol. The resultant mixture is heated to 105° C. under continuous stirring. Then, 400 g (1.8 mol) IPDI and 160 g acetone are added. After four hours of continuous stirring at 105° C., 1,600 g of acetone are added and the resultant mixture is cooled to 45° C. The NCO contents are determined, 1.11% by weight (calc.: 1.08% by weight). Then, 68 g (0.4 mol) of IPDA are added and stirring is continued for 90 minutes. After said 90 minutes, 50 g (0.73 mol) of 25% by weight aqueous ammonia is added and the resultant polyurethane is dispersed in 3 kg of water. The acetone is distilled off under reduced pressure, and a 30% by weight solids content aqueous dispersion of polyurethane foam B having an average pore diameter of 0.5 mm is obtained.

I.3 Synthesis of Polyurethane Foam C:

A flask with stirrer is charged with 400 g (0.2 mol) of a polyesterdiol (hydroxyl number 56 mg KOH/g) made by condensation from adipic acid, neopentyl glycol and 1,6-hexanediol. The polyesterdiol is heated to 130° C. under vacuum (55 mbar) for 30 minutes. Then, the polyesterdiol is allowed to cool to room temperature. It is dissolved in 200 g of acetone and then mixed with 40.5 g of 1,4-butandiol. Then, 69.7 g of a mixture of isomers of tolulene diisocyanate (isomer ratio 2,4/2, 6:4:1) is added and additional 33.6 g of hexamethylene diisocyanate. As a catalyst, 0.02 g of DBTL is added. The resultant mixture is heated to 60° C. and stirred at 60° C. over a period of 60° C. Then, an amount of 300 g acetone is added and the mixture is cooled to room temperature. A 40% by weight aqueous solution (19.3 g) of the sodium salt of N-(2-aminoethyl)-2-aminoethanecarboxylic acid is added and stirring is continued. After 20 minutes, 800 ml of water are added dropwise. Then, the acetone is distilled off under reduced pressure. A 40% by weight solids content aqueous dispersion of polyurethane foam C having an average pore diameter of 0.06 mm is obtained.

I.4. Production of Melamine Foam D:

A spray-dried melamine-formaldehyde precondensate (molar ratio 1:3, molecular weight about 500) is added, in an open vessel, to an aqueous solution with 3% by weight of formic acid and 1.5% of the sodium salt of a mixture of alkylsulfonates having from 12 to 18 carbon atoms in the alkyl radical (K 30 emulsifier from Bayer AG), the percentages being based on the melamine-formaldehyde precondensate. The concentration of the melamine-formaldehyde precondensate, based on the entire mixture composed of melamine-formaldehyde precondensate and water, is 74%. The resultant mixture is vigorously stirred, and then 20% of n-pentane is added. Stirring is continued (for about 3 min) until a dispersion of homogeneous appearance is produced. This is applied onto a Teflon®-treated glass fabric as substrate material and foamed and cured in a drying cabinet in which the prevailing air temperature is 150° C. The resultant temperature within the foam composition is the boiling point of n-pentane, which is 37.0° C. under these conditions. After from 7 to 8 min, the foam rises to its maximum height. The foam is then left for a further 10 min at 150° C. in the drying cabinet; it is then heat-conditioned for 30 min at 180° C. This gives melamine foam D having an average pore diameter of 200 um.

I.5. Commercial Melamine Foam E and Compressed Melamine Foams F and G:

Melamine-formaldehyde resin foam produced and commercially marketed by BASF under the trade name Basotect®, having an average pore diameter of 500 um, is referred to herein as commercial melamine foam E. This material is compressed per the processes described in U.S. Pat. No. 6,608,118, to Kosaka et al., to produce compressed melamine foams: (a) by following Example 1 is produced a 1:10 compressed melamine foam referred to herein as compressed melamine foam F having an average pore diameter of 450 um; and (b) by following Example 1 is produced a 1:2 compressed melamine foam referred to herein as compressed melamine foam F having an average pore diameter of 250 um.

I.6. Commercial Polyurethane Foam H:

Polyether polyurethane foam produced and commercially marketed by Foamex under the trade name SIF Felt®, having an average pore size of 20 ppi (pores per linear inch), is referred to herein as commercial polyurethane foam H. This material is manufactured by compressing 90-ppi reticulated foam under heat to impart a permanent compression having an average pore diameter of 0.95 mm.

I.7. Commercial Polyester Foam I:

Polyester foam produced and commercially marketed by Foamex under the trade name SIF Felt®, having an average pore size of 30 ppi is manufactured by compressing 90-ppi reticulated foam under heat to impart a permanent compression having an average pore diameter of 0.58 mm.

II. Fabric Exfoliation Articles and Fabric Exfoliation Methods:

II.1 Fabric Exfoliation Article 1 and Fabric Exfoliation Method:

A single layer fabric exfoliation article having a cuboid shape with grooves defined by three groups of parallel and equal length sides, referred to as a, b and c, with a being 6.5 cm, b being 12 cm, and c being 3 cm is cut from melamine foam D. A fabric substantive perfume ingredient containing a quarternary ammonium chloride salt is applied to the grooved portion of the article.

Fabric Exfoliation Article 1 is used to remove lint and pills from the surface of a 100% fine knit acrylic sweater. The Fabric Exfoliation Article 1 is used in the dry state and brought into contact with the fabric surface to remove the lint and pill artifacts with grooves perpendicular to the wiping motion to exfoliate the fabric. The sweater surface is rubbed with the article until all the pills and lint are removed or no further change in the surface of the sweater is noticed. Fabric Exfoliation Article 1 shows an excellent performance in removing lint and pills from the sweater. Similar results from the fabric exfoliation method are obtained when the Fabric Exfoliation Article 1 is cut from polyurethane foam A, polyurethane foam B, polyurethane foam C, commercial melamine foam E, compressed melamine foam F, compressed melamine foam G, commercial polyurethane foam H, and polyester foam 1.

II.2 Fabric Exfoliation Article 2 and Fabric Exfoliation Method:

A dual layer fabric exfoliation article having a cuboid shape defined by three groups of parallel and equal length sides, referred to as a, b and c, with a being 6.5 cm, b being 12 cm, and c being 4 cm is made by foam flame laminating a first layer of melamine foam D, having a thickness—side c—of 2 cm to a second layer of polyurethane foam A, having a thickness—side c—of 1 cm. The two layers are joined together at the plane formed by sides a and b. A fabric substantive perfume ingredient is applied to the melamine layer and a lubricant is applied to the polyurethane layer.

Fabric Exfoliation Article 2 is used to remove lint and pills from a 50% cotton/50% polyester sweatshirt. Fabric Exfoliation Article 2 is used in the dry state and brought into contact with the fabric surface to remove the lint and pill artifacts. The polyurethane layer is used to collect the pills removed by using the opposite side of the foam. Similar results from the fabric exfoliation method are obtained when the polyurethane foam layer of the Fabric Exfoliation Article 2 is cut from polyurethane foam B, polyurethane foam C, and commercial polyurethane foam H. Fabric Exfoliation Article 2 may also be constructed to provide beneficial fabric exfoliation results by substituting commercial melamine foam E, compressed melamine foam F, or compressed melamine foam G for the melamine foam D in any of the above constructions of Fabric Exfoliation Article 2. In a further construction of Fabric Exfoliation Article 2, the polyurethane foam A is replaced with any of the commercial melamine foam E, compressed melamine foam F, or compressed melamine foam G to provide fabric exfoliation benefits. Similarly for a modification of the first construction of Fabric Exfoliation Article 2 above, the melamine foam D is replaced with commercial melamine foam E and the polyurethane foam A is replaced with either compressed melamine foam F, compressed melamine foam G, foam H or foam I.

II.3 Fabric Exfoliation Article 3 and Fabric Exfoliation Method:

A single layer fabric exfoliation article having a cuboid shape with ripples parallel to the shortest side defined by three groups of parallel and equal length sides, referred to as a, b and c, with a being 6.5 cm, b being 12 cm, and c being 3 cm is cut from melamine foam D. The ripples are depressed into the foam with a 15% depth of the foam's thickness. A fabric substantive perfume ingredient is added to the top portion (that contacts the fabric) of the ripples and an adhesive is applied to the lower portion of the ripple (in the recesses of the ripples).

Fabric Exfoliation Article 3 is used to remove lint, pills and hair from the surface of a cashmere sweater. The Fabric Exfoliation Article 3 is used in the dry state and brought into contact with the fabric surface to remove the artifacts. The sweater surface is rubbed with the article until all the pills and lint are removed or no further change in the surface of the sweater is noticed. The sweater treated with Fabric Exfoliation Article 3 displays a rejuvenated fabric appearance with the release of perfume fragrance. Similar results from the fabric exfoliation method are obtained when the Fabric Exfoliation Article 3 is cut from polyurethane foam A, polyurethane foam B, polyurethane foam C, commercial melamine foam E, compressed melamine foam F, compressed melamine foam G, commercial polyurethane foam H, and polyester foam I.

II.4 Fabric Exfoliation Article 4 and Fabric Exfoliation Method:

An exfoliation article made from polyurethane foam B having a cuboid shape defined by three groups of parallel and equal length sides, referred to as a, b and c, with a being 6.5 cm, b being 12.5 cm, and c being 2.5 cm has holes drilled through the b face parallel to the a and c faces.

Fabric Exfoliation Article 4 is used to remove lint and pills from a 65% cotton/35% polyester knit. Fabric Exfoliation Article 4 is used in the dry state and brought into contact with the fabric surface that is sprayed with water to mitigate generation of static during removal of the lint and pill artifacts. The article is used to collect the pills in the pores of the foam. Similar results from the fabric exfoliation method are obtained when the Fabric Exfoliation Article 4 is cut from polyurethane foam A, polyurethane foam C, melamine foam D, commercial melamine foam E, compressed melamine foam F, compressed melamine foam G, commercial polyurethane foam H, and polyester foam I, The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "5 mm" is intended to mean "about 5 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric exfoliation article, comprising a foam, said foam consisting of an open-cell polyurethane foam having a thickness and having a functional polyurethane open-cell foam surface available for contacting the surface of a fabric in need of exfoliation, said foam comprising macroscopic recesses wherein the unwanted material exfoliated from said fabric is trapped and collected, wherein said macroscopic recesses in said article comprise a depth that is from 0.5% to 50% of the thickness of said foam said foam having a pore content from 30 pores per inch to 500 pores per inch.

2. An article according to claim 1 wherein said recesses comprise slits, slots, or grooves, in said article, and wherein said article optionally further comprises an adherent material in said recesses.

3. An article according to claim 1 wherein said recesses comprise ripples on the functional surface of said article.

4. A method for fabric exfoliation, comprising contacting with agitation the surface of a fabric in need of exfoliation with the functional polyurethane open-cell foam surface of a fabric exfoliation article according to claim 1.

* * * * *